US007727046B2

(12) United States Patent
Kobayashi

(10) Patent No.: US 7,727,046 B2
(45) Date of Patent: Jun. 1, 2010

(54) BEATING APPLIANCE FOR CHEERING

(75) Inventor: Yuu Kobayashi, Osaka (JP)

(73) Assignee: Sharp Sangyo Co., Ltd., Kobe-shi (JP)

( * ) Notice: Subject to any disclaimer, the term of this patent is extended or adjusted under 35 U.S.C. 154(b) by 899 days.

(21) Appl. No.: 10/567,970

(22) PCT Filed: Aug. 9, 2004

(86) PCT No.: PCT/JP2004/011443

§ 371 (c)(1),
(2), (4) Date: Feb. 10, 2006

(87) PCT Pub. No.: WO2005/015542

PCT Pub. Date: Feb. 17, 2005

(65) Prior Publication Data

US 2006/0293129 A1 Dec. 28, 2006

(30) Foreign Application Priority Data

Aug. 12, 2003 (JP) ..... 2003-292153

(51) Int. Cl.
*A63H 5/00* (2006.01)

(52) U.S. Cl. ..... 446/418

(58) Field of Classification Search ..... 248/157, 248/158, 159, 161, 351, 354.1; 446/418, 446/421

See application file for complete search history.

(56) References Cited

U.S. PATENT DOCUMENTS 1,746,487 A * 2/1930 Martin ..... 211/33
2,733,885 A * 2/1956 Brown et al. ..... 248/161
2,757,002 A * 7/1956 Ryden ..... 43/4

(Continued)

FOREIGN PATENT DOCUMENTS

JP 7888 7/1927

(Continued)

OTHER PUBLICATIONS

The Examination Report issued by the UK Patent Office for corresponding patent application No. GB0602620.7, dated Oct. 24, 2006.

*Primary Examiner*—John Ricci
(74) *Attorney, Agent, or Firm*—Edwards Angell Palmer & Dodge LLP

(57) ABSTRACT

A beating appliance (1) for cheering easy to beat and suitable for carrying, comprising a body portion having a plurality of tubular members (10), (20), and (30) reduced in diameter from one end to the other end in the longitudinal direction and combined with each other so as to be extended/retracted. The tubular members (10), (20), and (30) adjacent to each other are brought into an extended state by connecting the inner peripheral surfaces of the large diameter side tubular members (10) and (20) to the outer peripheral surfaces of the small diameter side tubular members (20) and (30) in taper-stacked states, and brought into a retracted state by storing the small side tubular members (20) and (30) in order and in a nested state in the large diameter side tubular members (10) and (20). Also, a head cap (40) is fitted to one end of the maximum diameter tubular member (10), and an end member (50) having a diametrically grip end (51) is fitted to the other end of the minimum diameter tubular member (30).

9 Claims, 10 Drawing Sheets

U.S. PATENT DOCUMENTS

| | | | | | |
|---|---|---|---|---|---|
| 2,790,657 | A | * | 4/1957 | Wilder | 403/105 |
| 2,957,187 | A | * | 10/1960 | Raia | 5/503.1 |
| 4,214,751 | A | | 7/1980 | Simpson | |
| 5,161,800 | A | * | 11/1992 | Parsons et al. | 463/47.4 |
| 5,348,297 | A | * | 9/1994 | Parsons | 463/47.7 |
| 5,667,441 | A | * | 9/1997 | Parsons | 463/47.7 |
| 6,056,643 | A | * | 5/2000 | Wilmoth, III | 463/47.7 |
| 7,210,264 | B1 | * | 5/2007 | Demetris | 43/23 |

FOREIGN PATENT DOCUMENTS

| | | |
|---|---|---|
| JP | 5-4200 | 1/1993 |
| JP | 3050160 | 4/1998 |
| JP | 2000-352985 | 12/2000 |
| JP | 2002-315971 | 10/2002 |
| JP | 3099832 | 12/2003 |

* cited by examiner

BEATING APPLIANCE FOR CHEERING

FIELD OF THE INVENTION

The present invention relates to a beating appliance for cheering used for sports watching.

BACKGROUND ART

As a tool used for cheering of various competitive sports such as baseball, for example, a beating appliance in which two bar members imitating a bat are used by beating them as if beating wooden clappers (for example, the following Non-Patent Reference).

The beating appliance is made of a hollow resin-molded article, emits a light batting sound, and elates cheering atmosphere. Non-Patent Reference 1: kung-fu bat, [Aug. 8, 2003 search], the Internet <URL:http://www.rakuten.co.jp/thebay-stars/167265/167337/171057/170569/>

SUMMARY OF THE INVENTION

Problem to be Solved by the Invention

The beating appliance has a length of about 30 to about 40 cm, has a lightweight and is bulky, thus the beating appliance is inconvenient for carrying. However, if the beating appliance is simply shortened, it is hard to beat the beating appliance and the batting sound is worsened, thus it is considered that an enthusiastic cheering mood becomes lacking.

The present invention has been made taking the present status described above, and it is an object of the present invention to provide a beating appliance for cheering easy to beat and suitable for carrying.

Means for Solving the Problems

So as to achieve the aforementioned object, the beating appliance for cheering of the present invention has the following construction.

[1] A beating appliance for cheering, comprising a body portion having a plurality of tubular members reduced in diameter from one end to the other end in the longitudinal direction and combined with each other so as to be extended/retracted, wherein the tubular members adjacent to each other are brought into an extended state by connecting an inner peripheral surface of a large diameter side tubular member to an outer peripheral surface of a small diameter side tubular member in taper-stacked states, and brought into a retracted state by storing the small diameter side tubular member in order in a nested state into the large diameter side tubular member.

[2] The beating appliance for cheering as recited in the aforementioned Item [1], wherein a head cap is fitted to one end of a maximum diameter tubular member, and an end member having a diametrically increased grip end is fitted to the other end of a minimum diameter tubular member.

[3] The beating appliance for cheering as recited in the aforementioned Item [1] or [2], wherein a projecting portion or a recessed portion is formed on the inner peripheral surface of the large diameter side tubular member; a recessed portion or projecting portion corresponding to the projecting portion or recessed portion is formed on the outer peripheral surface of the adjacent small diameter side tubular member; and the extended state is held by a fit between the projecting portion and the recessed portion.

[4] The beating appliance for cheering as recited in any one of the aforementioned Items [1] to [3], wherein the retracted state of the body portion is held by locking one end of the minimum diameter tubular member by the head cap.

[5] The beating appliance for cheering as recited in the aforementioned Items [4], wherein the head cap has a locking projecting portion projecting to the body portion, and the locking projecting portion and the minimum diameter tubular member are locked by screw-fitting the locking projecting portion to one end of the minimum diameter tubular member.

[6] The beating appliance for cheering as recited in any one of the aforementioned Items [1] to [3], wherein the retracted state is held by putting an end cap from the other end side in the retracted state of the body portion and locking the end cap to a maximum diameter tubular member.

[7] A beating appliance for cheering composed by coupling two beating appliances for cheering as recited in any one of the aforementioned Items [1] to [6] through a string.

EFFECT OF THE INVENTION

According to the beating appliance for cheering as recited in the present invention [1], the length suitable for beating is held in the extended state of the body portion. On the other hand, in the retracted state, the length of the beating appliance is short, and the beating appliance has a length suitable for carrying.

According to the beating appliance for cheering as recited in the present invention [2], the appliance generally has a bat shape in appearance.

According to the beating appliance for cheering as recited in the present invention [3], the extended state is more surely held.

According to the beating appliance for cheering as recited in the present invention [4], the retracted state is held.

According to the beating appliance for cheering as recited in the present invention [5], the retracted state is more surely held.

According to the beating appliance for cheering as recited in the present invention [6], the retracted state can be stably held without providing a particular holding structure on the body portion and head cap, and these members can be simplified.

According to the beating appliance for cheering as recited in the present invention [7], loosing of the beating appliance is prevented and the convenience during cheering and carrying can be improved.

DESCRIPTION OF REFERENCE NUMERALS

Figure 1A:
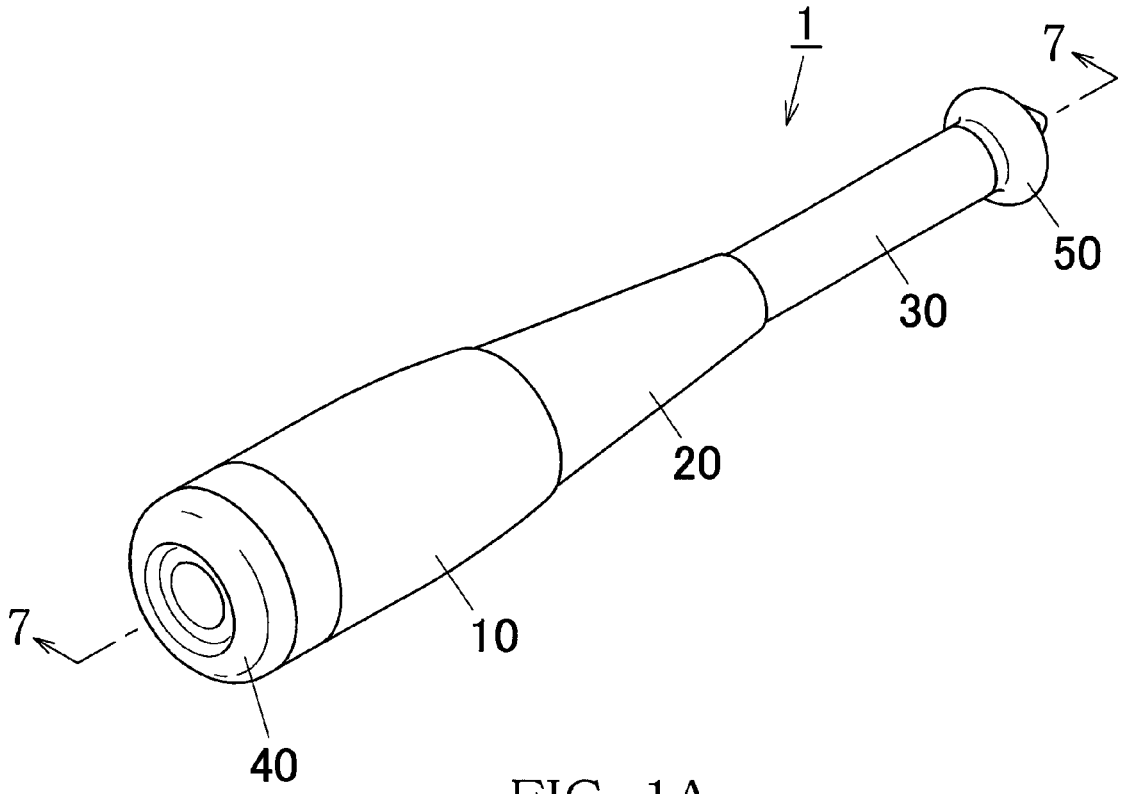
FIG. 1A is an overall perspective view showing an extended state of a beating appliance for cheering according to a first embodiment of the present invention.

1, 2 - - - Beating appliance for cheering
10, 110 - - - Head member (maximum diameter tubular member)
13, 23 - - - Recessed groove (recessed portion)
20, 120 - - - Intermediate member (tubular member)
22, 33 - - - Protruded strip (projecting portion)
30, 130 - - - Grip member (minimum diameter tubular member)
40, 140 - - - Head cap
43 - - - Projecting portion for locking
50, 150 - - - End member
51, 151 - - - Grip end
160 - - - End cap

BEST MODE FOR CARRYING OUT THE INVENTION

First Embodiment

FIGS. 1A to 8 show a beating appliance (1) for cheering.

In a beating appliance (1) for cheering, a body portion has three tubular members of a head member (10), intermediate member (20) and grip member (30), each has a reduced diameter in series in the longitudinal direction and combined with each other so as to be extended/retracted. A head cap (40) is fitted to the head member (10) having a maximum diameter, and an end member (50) is fitted to the grip member (30) having a minimum diameter. The beating appliance for cheering has a length of about 30 cm and generally has a bat shape in appearance in the extended state shown in FIG. 1A.

Figure 2:
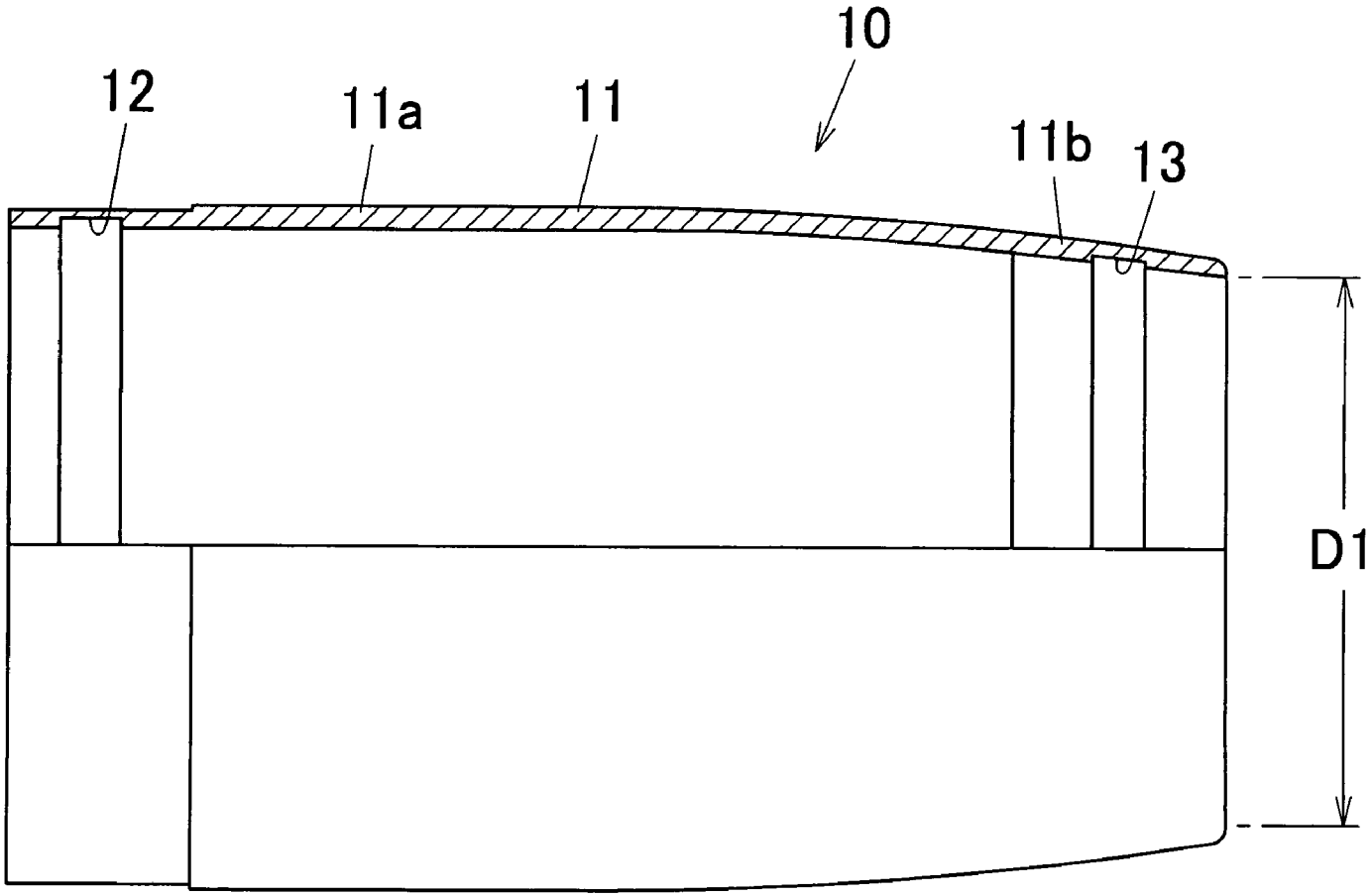
FIG. 2 is a sectional view of a head member of the beating appliance for cheering of FIG. 1A.

The peripheral wall (11) of the head member (10) shown in FIG. 2 is formed to have a constant diameter at the end side (11*a*) of the head, has a gradual tapered shape at the grip side (11*b*), and is a tubular member of which the diameter is reduced at the grip side (11*b*). A recessed groove (12) is formed on the inner peripheral surface of the end side (1*a*) of the head of the peripheral wall along the circumferential direction, and a recessed groove (13) shallower than the recessed groove (12) is similarly formed on the inner peripheral surface of the grip side (11*b*) along the circumferential direction.

Figure 3:
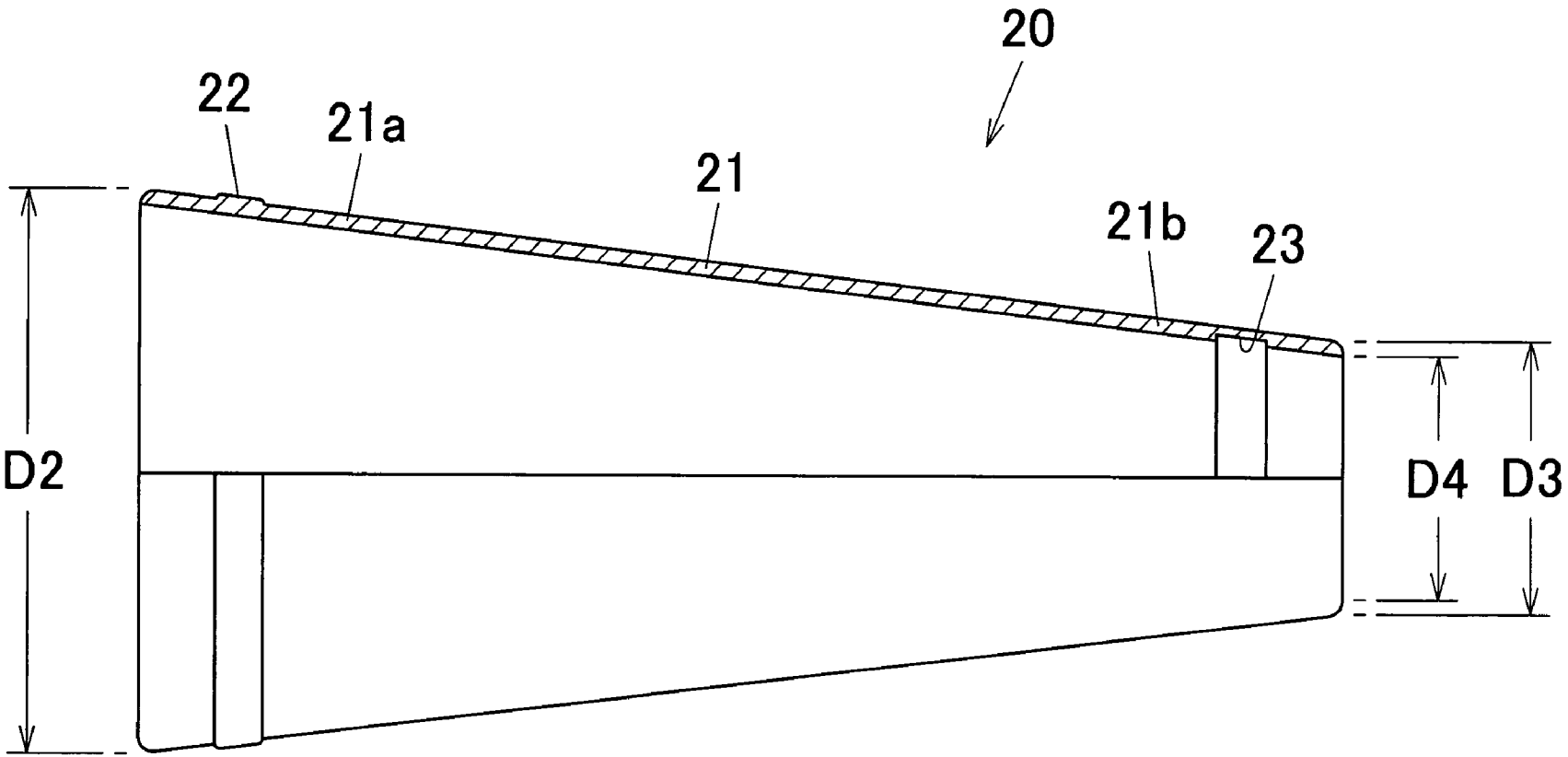
FIG. 3 is a sectional view of an intermediate member of the beating appliance for cheering of FIG. 1A.

The intermediate member (20) shown in FIG. 3 is a tubular member of which the diameter of the peripheral wall (21) is reduced toward the grip side (21*b*) from the head side (21*a*) and which has a tapered shape. The outer diameter (D2) of the end portion of the head side (21*a*) of the intermediate member (20) is slightly larger than the opening diameter (D1) of the grip side (11*b*) of the head member (10), and the outer diameter (D3) of the end portion of the grip side (21*b*) is sufficiently smaller. A protruded strip (22) corresponding to the recessed groove (13) of the grip side (11*b*) of the head member (10) is formed on the outer peripheral surface of the head side (21*a*) of the peripheral wall. On the other hand, a shallow recessed groove (23) is formed on the inner peripheral surface of the grip side (21*b*) along the circumferential direction.

Figure 4A:
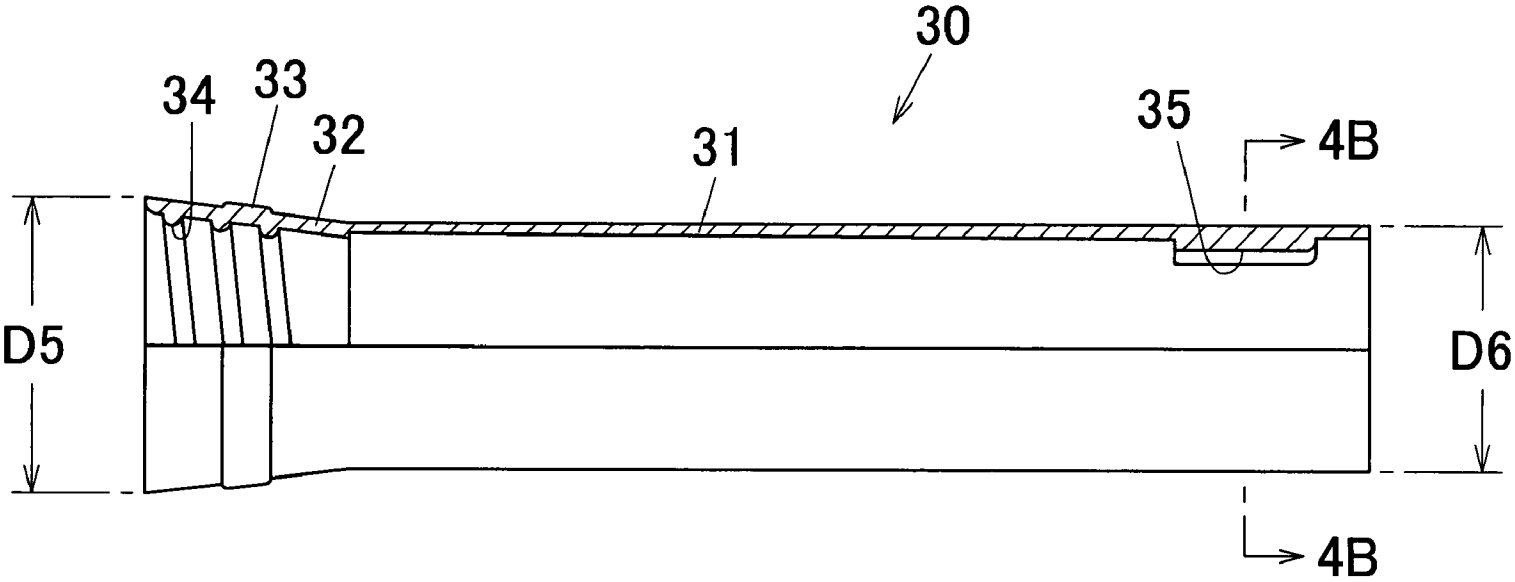
FIG. 4A is a sectional view of a grip member of the beating appliance for cheering of FIG. 1A.
Figure 4B:
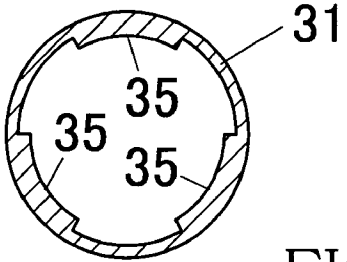
FIG. 4B is a sectional view taken along the line 4B-4B in FIG. 4A.

The grip member (30) shown in FIG. 4 is a tubular member in which a locking portion (32) is extended of which the diameter of the end is large at the head side of a substrate portion (31) having an equal diameter in the longitudinal direction and which has a tapered shape. The outer diameter (D5) of the end portion of the locking portion (32) is slightly larger than the opening diameter (D4) of the end portion of the grip side (21*b*) of the intermediate member (20), and the outer diameter (D6) of the substrate portion (31) is sufficiently smaller. A protruded strip (33) is formed on the outer peripheral surface of the locking portion (32) along the circumferential direction, and a spiral protruded strip (34) is provided so as to project on the inner peripheral surface. The protruded strip (33) corresponds to recessed groove (23) of the intermediate member (20), and the spiral protruded strip (34) is engaged with a head cap (40) to be described below. On the other hand, three projecting portions (35), (35), (35) are formed on the inner peripheral surface of the base end side of the substrate portion (31) at equal intervals along the circumferential direction.

Figure 5:
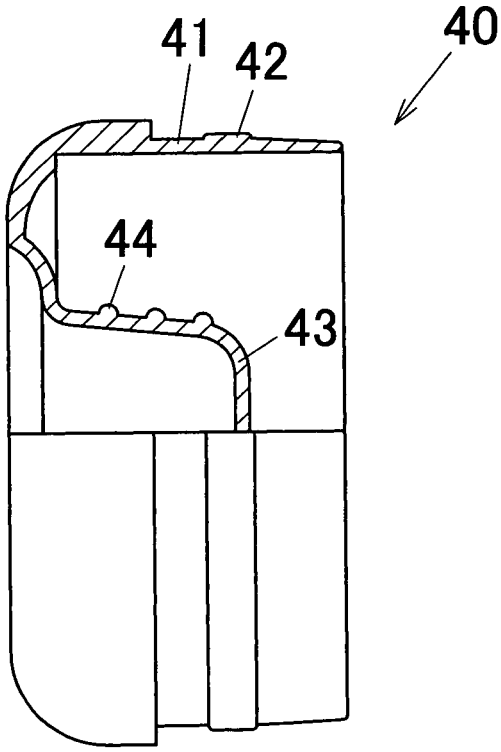
FIG. 5 is a sectional view of ahead cap of the beating appliance for cheering of FIG. 1A.
Figure 7:
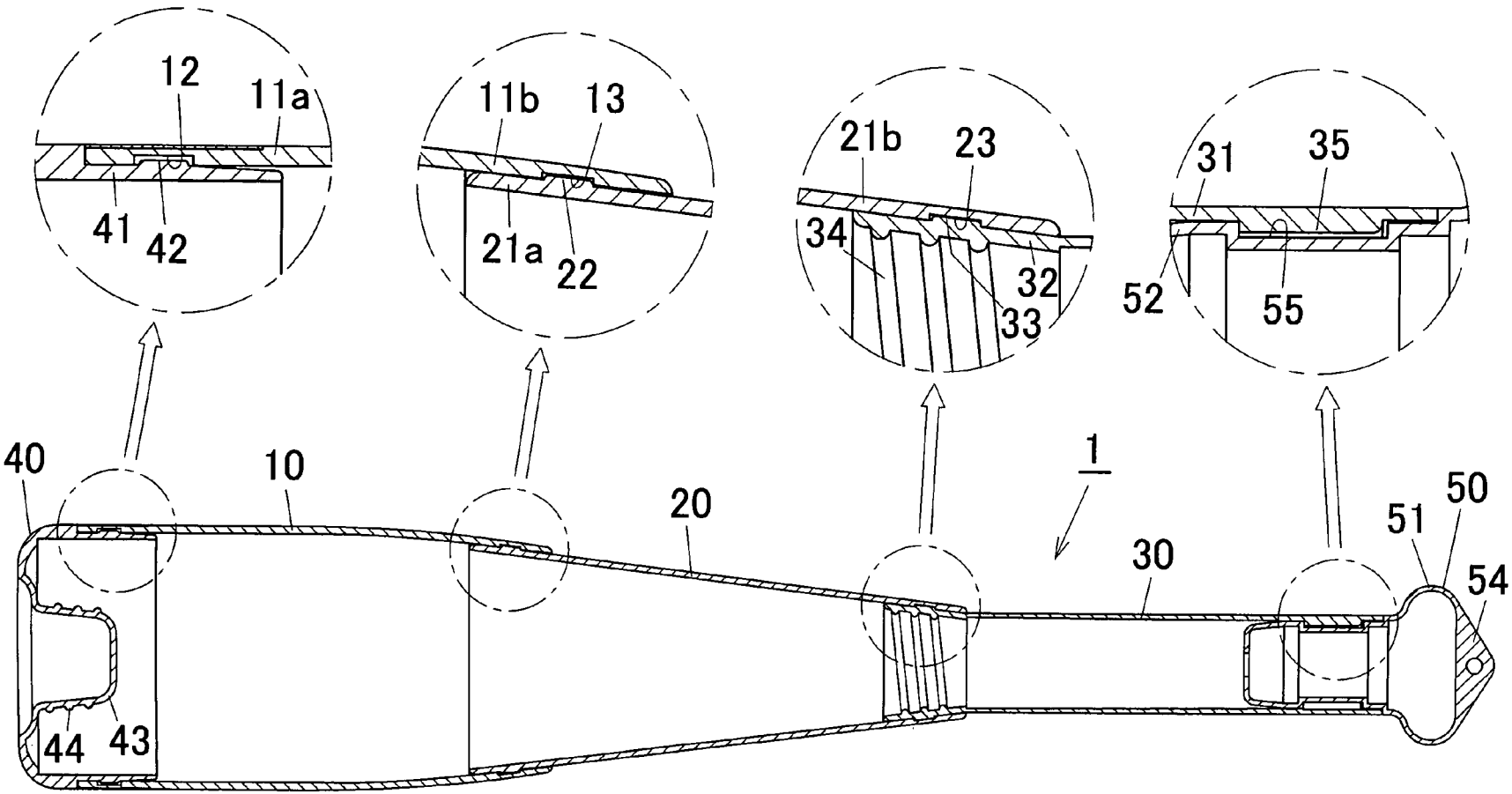
FIG. 7 is a sectional view taken along the line 7-7 in FIG. 1A.
Figure 8:
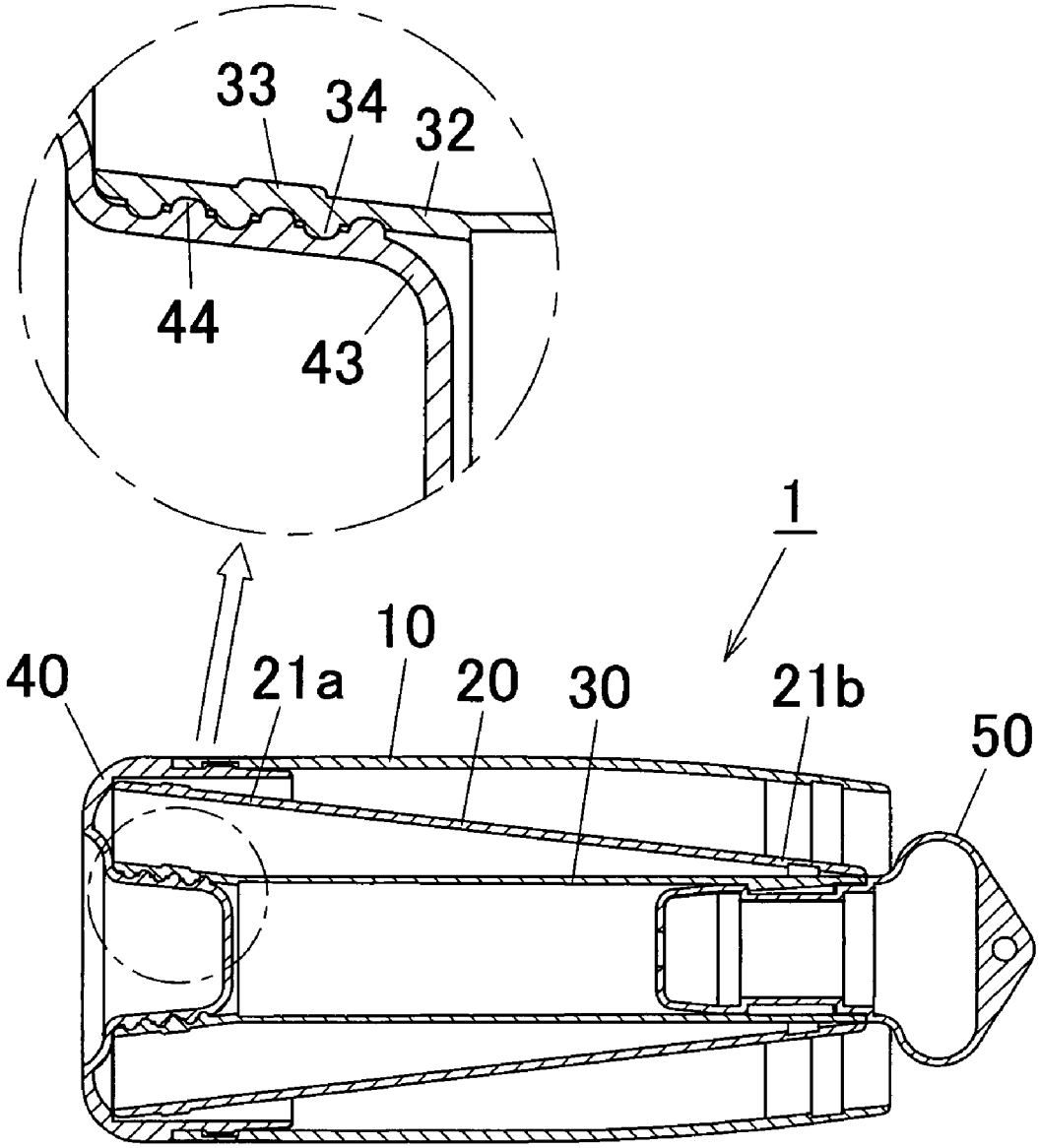
FIG. 8 is a sectional view taken along the line 8-8 in FIG. 1B.

The head cap (40) shown in FIG. 5 is a short-sized tubular member having a bottom. A protruded strip (42) is formed on the outer peripheral surface of the peripheral wall (41) along the circumferential direction, and a locking projecting portion (43) projecting to the body portion side and having a small diameter at the end side is formed at the center of a bottom portion. A spiral protruded strip (44) is provided so as to project on the peripheral surface (projection surface) of the locking projecting portion (43). The outer circumferential wall (41) of the head cap (40) is inserted into the end side (11*a*) of the head member (10), and the protruded strip (42) is fitted to the recessed groove (12) of the head member (10), thereby being fitted to the head member (10) (FIG. 7). The spiral protruded strip (44) of the locking projecting portion (43) corresponds to the spiral protruded strip (34) of the locking portion (32) of the grip member (30), and these are engaged at the time of reduction of the body (FIG. 8).

Figure 6:
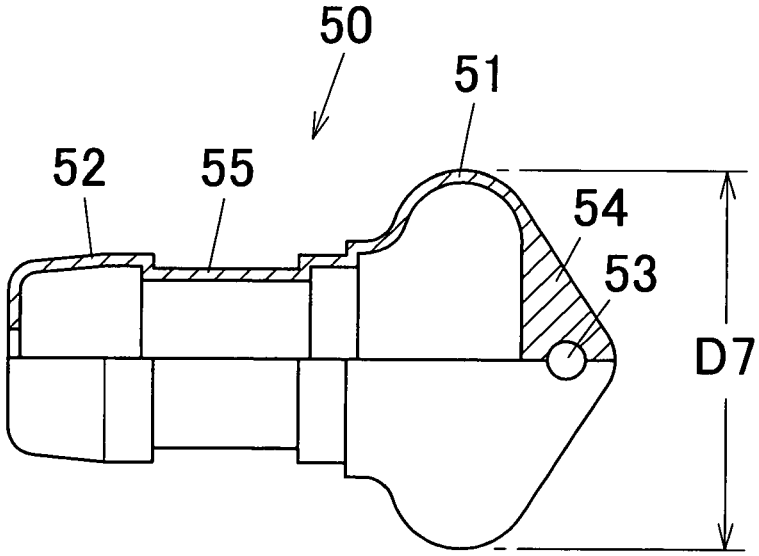
FIG. 6 is a sectional view of a grip end of the beating appliance for cheering of FIG. 1A.

The end member (50) shown in FIG. 6 is a hollow member in which a cylindrical locking portion (52) is integrally extended to the one surface side of a diametrically increased grip end (51). A tabular coupling string attaching portion (54) in which a hole (53) is bored is provided so as to project to the other surface side of the grip end (51). A recessed groove (55) is formed on the outer peripheral surface of the locking portion (52) along the circumferential direction, and the recessed groove (55) corresponds to the projecting portion (35) of the substrate portion (31) of the grip member (30), thereby the end member (50) being fitted by the fit thereof. The outer diameter (D7) of the grip end (51) is larger than the opening diameter (D4) of the grip side of the intermediate member (20).

The members described above are assembled by the procedures of the following items <1> to <3>.

<1> The intermediate member (20) is inserted from the end side (11*a*) of the head of the head member (10), and the grip member (30) is inserted from the head side (21*a*) of the intermediate member (20). Since the three members (10), (20), (30) satisfy the relationship of the grip side opening diameter (D1) of the head member (10)<the head side outer diameter (D2) of the intermediate member (20), and the grip side opening diameter (D4) of the intermediate member (20) <the outer diameter (D5) of the locking recessed portion (32) of the grip member (30), the three members (10), (20), (30) are in a locked state in an extended direction. That is, connection portions with the adjacent members are formed in tapered shape, and the connection portions are overlapped by the difference between the opening diameter and the outer diameter, and are in a locked state.

<2> As the grip member (30) is pulled out from the grip side (21*b*) of the intermediate member (20). As shown in FIG. 7, the locking portion (52) of the end member (50) is inserted into the substrate portion (31) of the grip member (30), and the end member (50) is attached by fitting the projecting portion (35) to the recessed groove (55). Since a relationship of the grip side opening diameter (D3) of the intermediate member (20)<the outer diameter (D7) of the grip end (51) is satisfied, the intermediate member (20) and the grip member (30) are in the locked state in a reduced direction.

<3> As shown in FIG. 7, the outer circumferential wall (41) of the head cap (40) is inserted into the end side of the head member (10), and the head cap (40) is attached by fitting the protruded strip (42) to the recessed groove (12). The opening portion of the end side of the head member (10) is blockaded by attaching the head cap (40), and the intermediate member (20) and the head member (10) is in the locked state in the reduced direction.

The assembled beating appliance (1) for cheering is held in the extended state or the retracted state as follows.

<Extended State>

The head member (10), the intermediate member (20) and the grip member (30) are pulled in the extended direction. Then, as shown in FIGS. 1A and 7, the inner peripheral surface of the head member (10) comes into contact with the outer peripheral surface of the intermediate member (20) in a state where they are mutually pushed in the connection portion of the head member (10) and intermediate member (20), and the protruded strip (22) of the intermediate member (20) is fitted to the recessed groove (13) of the head member (10). In the connection portion of the intermediate member (20) and grip member (30), the inner peripheral surface of the intermediate member (20) comes into contact with the outer peripheral surface of the grip member (30) in a state where they are mutually pushed, and the protruded strip (33) of the locking portion (32) of the grip member (10) is fitted to the recessed groove (23) of the intermediate member (20). The extended state of the beating appliance (1) for cheering is held by the surface contact and the rugged fit. The beating appliance (1) for cheering has a length suitable for beating at the time of the extension.

<Retracted State>

Figure 1B:
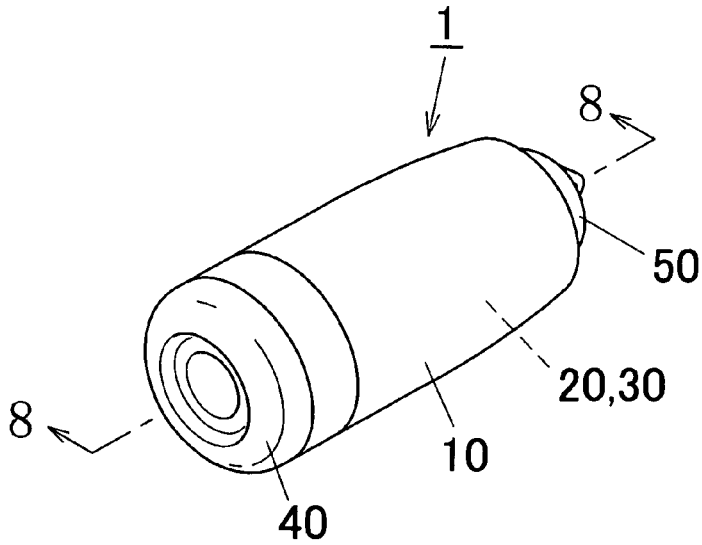
FIG. 1B is an overall perspective view showing a retracted state of the beating appliance for cheering of FIG. 1A.

The head member (10), the intermediate member (20) and the grip member (30) are pushed in the reduced direction. Then, as shown in FIGS. 1B and 8, the rugged fits among the three members (10), (20), (30) are released, and the grip member (30) is stored in the intermediate member (20). The intermediate member (20) is stored in the head member (10), and the other members (20), (30) are stored in a nested state in the head member (10). The locking projecting portion (43) of the head cap (40) is screw-fitted to the locking portion (32) of, the grip member (30), and the head cap (40) and the grip member (30) are locked. The head side (21*a*) of the intermediate member (20) is locked by the head cap (40), and the grip side (21*b*) is locked by the end member (50). The retracted state of the beating appliance (1) for cheering is held by the lock of the head cap (40) and grip member (30), and the lock of the intermediate member (20). Since the beating appliance (1) for cheering is locked by the engagement, the lock is not released only by pulling in the extended direction, and thereby the retracted state is surely held. The beating appliance (1) for cheering has a length of about ⅓ by the retraction, and is suitable for carrying.

Since the protruded strips (22), (33) and the recessed grooves (12), (23) for connecting the three members (10), (20), (30) have an engagement depth shallowly set than those of the protruded strip (42), projecting portion (35) and recessed grooves (13), (35) for attaching the head cap (40) and the end member (50), the rugged fit operation and operation of fitting release can be performed by small force. On the other hand, in the head cap (40) and end member (50) needing no fitting release after the assembly, the fitting depth is deep, and the head cap (40) and end member (50) are strongly fitted, thereby preventing the departure unwillingly.

Figure 9:
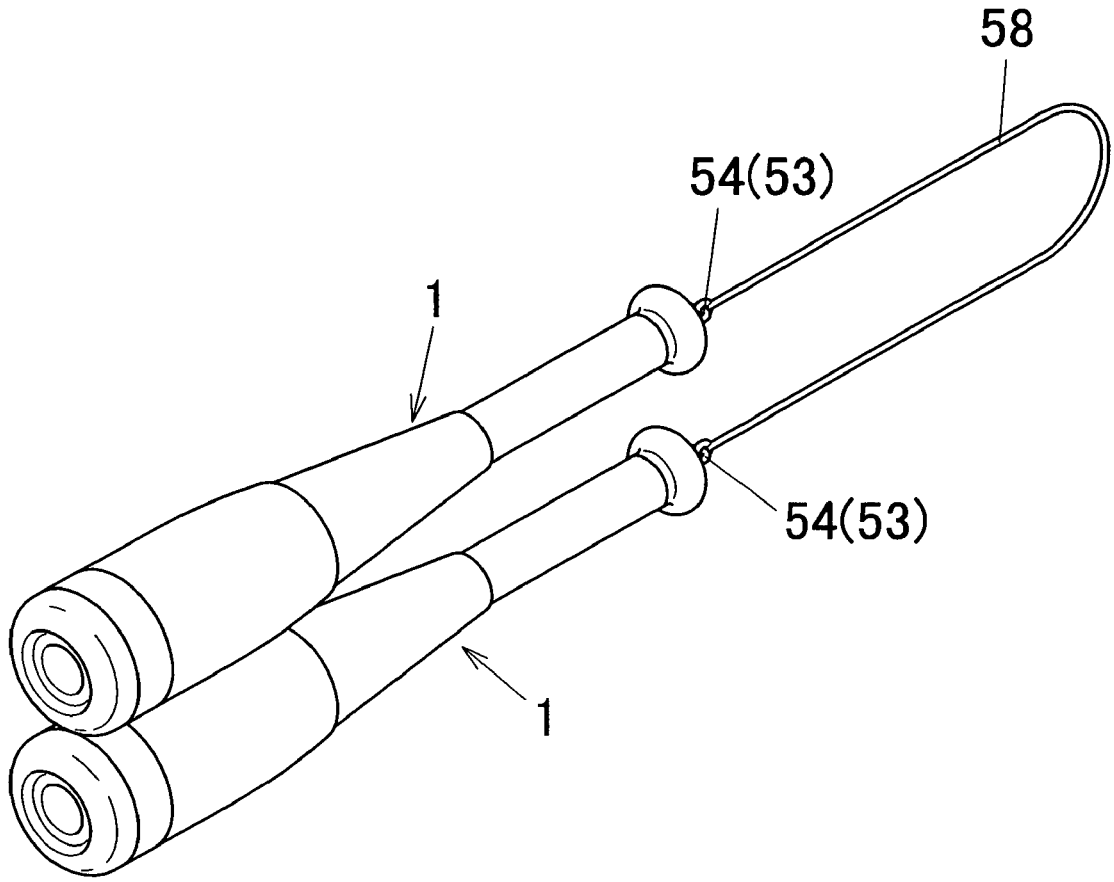
FIG. 9 is a perspective view showing an example of a method for using the beating appliance for cheering of FIG. 1A.

One beating appliance (1) for cheering can be also sounded by beating the beating appliance (1) against a user's hand and foot, and a light batting sound can be also emitted by beating two beating appliances (1) with each other. When a pair of beating appliances are used, as shown in FIG. 9, a string (58) is attached to a hole (53) of the coupling string locking portion (54) of the end member (50), and two beating appliances (1) for cheering are coupled, thereby preventing the dissipation and improving the convenience during cheering and carrying.

Second Embodiment

Figure 10:
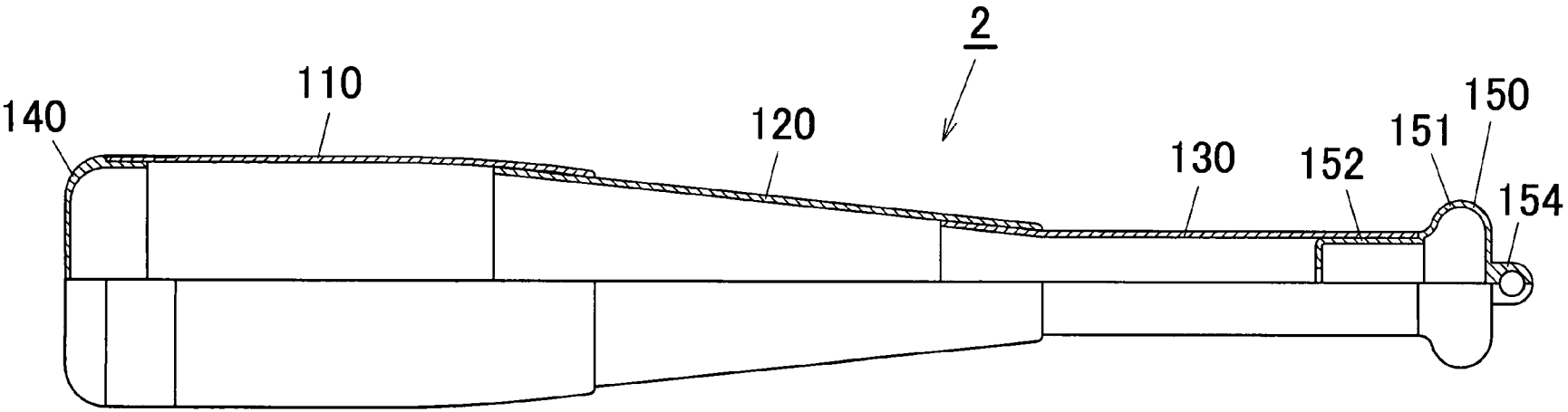
FIG. 10 is a sectional view showing an extended state of a beating appliance for cheering according to a second embodiment of the present invention.
Figure 11:
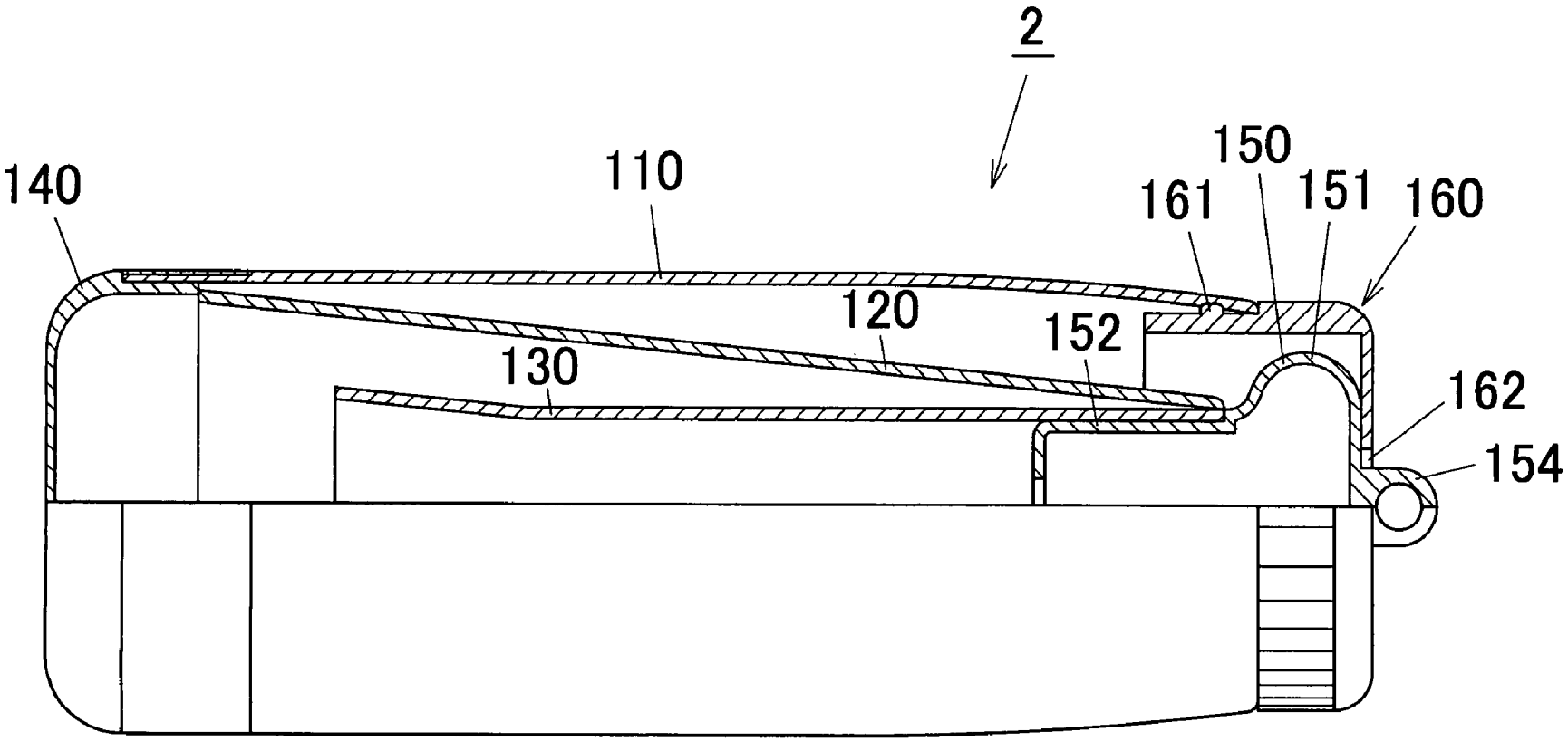
FIG. 11 is a sectional view showing the retracted state of the beating appliance for cheering of FIG. 10.

FIGS. 10 and 11 show a beating appliance (2) for cheering.

The beating appliance (2) for cheering has a different holding structure for holding the extended state and the retracted state from that of the beating appliance (1) for cheering of the first embodiment. The beating appliance (2) for cheering is common in the beating appliance (1) for cheering in the followings. In the beating appliance (2) for cheering, a body portion has three tubular members of a head member (110), intermediate member (120) and grip member (130) reduced in diameter in the longitudinal direction and combined with each other so as to be extended/retracted. A head cap (140) is attached to the head member (110), and an end member (150) is attached to the grip member (130). The beating appliance (2) for cheering has an almost bat shape in its appearance view in the extended state. Numeral (151) designates a diametrically increased grip end, and numeral (152) designates a cylindrical locking portion for inserting into the grip member (130). Numeral (154) designates an attaching portion of a coupling string for connecting the two beating appliances (2) for cheering.

Unevenness is not formed in the connection portion with the adjacent member in the head member (110), the intermediate member (120) and the grip member (130), and the extended state is held by only the surface contact due to the inner peripheral surface of the head member (110) and the outer peripheral surface of the intermediate member (120), or the inner peripheral surface of the intermediate member (120) and the outer peripheral surface of the grip member (130) (FIG. 10). The head cap (140) and the end member (150) are also attached by press the peripheral wall into the head member (110) or the grip member (130) without forming the protruded strip and the recessed groove.

As shown in FIG. 11, the retracted state of the beating appliance (2) for cheering can be held by using the end cap (160). The end cap (160) is a short-sized tubular member having a bottom, and a spiral protruded strip (161) is provided so as to project on the outer peripheral surface of the peripheral wall. The opening diameter of the peripheral wall is larger than the grip side outer diameter of the intermediate member (120), and the diameter of the grip end (151) of the end member (150), and is smaller than the grip side opening diameter of the head member (110). A hole (162) for inserting the coupling string attaching portion (154) of the end member (150) is bored at the center of the bottom portion.

The head member (110), the intermediate member (120) and the grip member (130) are pushed in the reduced direction, and the grip member (130) is inserted into the intermediate member (120). The intermediate member (120) is inserted into the head member (110). The end cap (160) is put on the end member (150), and is inserted into the head member (110) while turning the end cap (160). The protruded strip (161) is abutted on the inner peripheral surface in a state where the protruded strip (161) is strongly pushed to the inner peripheral surface. Thereby, the intermediate member (120) and the grip member (130) are restrained in the head member (110) having both ends blockaded, and thereby the retracted state is held.

The beating appliances (2) for cheering can be used alone and the pair of beating appliances (2) for cheering can be used as in the beating appliance (1) for cheering of the first embodiment. When two beating appliances (2) are coupled by the coupling string, the two beating appliances (2) can be coupled to the coupling string locking portion (154) of the grip end (150) by passing the coupling string through the hole (162) of the bottom portion of the end cap (160).

In the beating appliance (2) for cheering of the embodiment, the retracted state can be stably held without providing a particular holding structure on the head cap (140) and the grip member (130) by adding the end cap (160), and these members are simplified.

The beating appliance for cheering of the present invention is not limited to two embodiments described above.

For example, the number of division of the body portion may be two or more. However, few number of division lengthens the size at the time of reduction and decreases the reduction effect. Much number of division increase the connection portion, and the appearance at the time of extension is worsened. In the beating appliance for cheering having a full length of about 30 cm, the number of division is preferably 2 to 4. Although neither the length nor the thickness is also limited, the full length at the time of extension is preferably 20 to 40 cm, and the maximum diameter is 3 to 10 cm in view of having the beating appliance in a hand and beating the beating appliance.

The rugged fit structure of the tubular members adjacent to each other is not limited to the protruded strip or recessed groove formed on all circumferences, and the projecting portion and recessed portion formed on a plurality of places of the circumferential direction can be also used as the rugged fit structure. The engaging structure due to the spiral strip can be also used in place of the rugged fit.

Since it is not necessary to remove the head caps (40), (140) and the end members (50), (150) after attaching, the head caps and the end members may be adhered in addition to the rugged fit or the press fit.

In the beating appliance (1) for cheering of the first embodiment, the locking method of the head cap (40) and grip member (30) is not limited to the engagement of the example shown. Examples of the other locking methods include rugged fit and press fit. One directly locked on a flat cap bottom is also contained in the present invention without providing the locking projecting portion (43) on the head cap (40).

The coupling string locking portions (54), (154) in end members (50), (150) are arbitrarily provided, and the beating appliance for cheering having no coupling string locking portions (54), (154) is also contained in the present invention. The coupling method of two beating appliances for cheering is also arbitrary, for example, the string can be also directly attached to the head side diameter reduced portion of the grip end.

The present application claims priority to Japanese Patent Application No. 2003-292153 filed on Aug. 12, 2003, the entire disclosures of which is incorporated herein by reference in their entireties.

The term and expression used herein are used for the description and not used for restrictively interpreting, the term and expression do not eliminate any equivalents of the feature matter shown herein and described. It must be recognized that the various modifications within the limit of the claim of the present invention are permitted.

INDUSTRIAL APPLICABILITY

The beating appliance for cheering of the present invention can be used for various sports watching.

The invention claimed is:

1. A beating appliance for cheering, comprising a body portion having a plurality of tubular members reduced in diameter from one end to another end in a longitudinal direction and combined with each other so as to be extended/retracted, wherein the tubular members adjacent to each other are brought into an extended state by connecting an inner peripheral surface of a large diameter tubular member to an outer peripheral surface of a small diameter tubular member in taper-stacked states, and brought into a retracted state by storing the small diameter tubular member in order in a nested state into the large diameter tubular member;

wherein the inner and outer peripheral surfaces of the tubular members have either a projecting portion or a complementary recessed portion that fit to hold the beating appliance in the extended state;

wherein each tubular member is a different shape;

wherein a head cap is fitted to one end of a maximum diameter tubular member;

wherein the retracted state of the body portion is held by locking one end of a minimum diameter tubular member by the head cap; and wherein the head cap has a locking projecting portion projecting to the body portion, and the locking projecting portion and the minimum diameter tubular member are locked by screw-fitting the locking projecting portion to one end of the minimum diameter tubular member.

2. The beating appliance for cheering as recited in claim 1, wherein an end member having a diametrically increased grip end is fitted to the other end of the minimum diameter tubular member.

3. A beating appliance for cheering composed by coupling two beating appliances for cheering as recited in claim 2 though a string.

4. The beating appliance for cheering as recited in claim 1, wherein the extended state is held by a fit between the projecting portion and the recessed portion.

5. A beating appliance for cheering composed by coupling two beating appliances for cheering as recited in claim 4 through a string.

6. The beating appliance for cheering as recited in claim 1, wherein an end member having a diametrically increased grip end is fitted to the other end of the minimum diameter tubular member, and the extended state is held by a fit between the projecting portion and the recessed portion.

7. A beating appliance for cheering composed by coupling two beating appliances for cheering as recited in claim 6 through a string.

8. The beating appliance for cheering as recited in claim 1, wherein an end member having a diametrically increased grip end is fitted to the other end of the minimum diameter tubular member, wherein the retracted state is held by putting an end cap from the other end side in the retracted state of the body portion and locking the end cap to the maximum diameter tubular member.

9. A beating appliance for cheering composed by coupling two beating appliances for cheering through a string, each beating appliance for cheering, comprising a body portion having a plurality of tubular members reduced in diameter from one end to another end in a longitudinal direction and combined with each other so as to be extended/retracted, wherein the tubular members adjacent to each other are brought into an extended state by connecting an inner peripheral surface of a large diameter tubular member to an outer peripheral surface of a small diameter tubular member in taper-stacked states, and brought into a retracted state by storing the small diameter tubular member in order in a nested state into the large diameter tubular member.

* * * * *